US008773488B2

(12) United States Patent
Nishino et al.

(10) Patent No.: US 8,773,488 B2
(45) Date of Patent: Jul. 8, 2014

(54) EXPOSURE HEAD AND PRODUCING METHOD THEREOF, CARTRIDGE, AND IMAGE FORMING APPARATUS

(75) Inventors: Yohei Nishino, Kanagawa (JP); Hirohito Yoneyama, Kanagawa (JP); Takashi Matsumura, Kanagawa (JP); Yoshinori Yamaguchi, Kanagawa (JP); Kiyokazu Mashimo, Kanagawa (JP); Katsuhiro Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 144 days.

(21) Appl. No.: 12/916,899

(22) Filed: Nov. 1, 2010

(65) Prior Publication Data

US 2011/0242258 A1 Oct. 6, 2011

(30) Foreign Application Priority Data

Apr. 2, 2010 (JP) ..... 2010-086235

(51) Int. Cl.
*B41J 27/00* (2006.01)
*B41J 15/14* (2006.01)

(52) U.S. Cl.
USPC ..... 347/258; 347/241; 347/244

(58) Field of Classification Search
USPC ..... 347/241, 244, 258
See application file for complete search history.

(56) References Cited

U.S. PATENT DOCUMENTS 5,126,905 A * 6/1992 Nomura et al. ..... 360/266.5
6,025,863 A 2/2000 Nakajima et al.
6,151,122 A * 11/2000 Taniguchi et al. ..... 356/399
7,274,514 B2 * 9/2007 Uematsu ..... 359/654
2004/0041518 A1 3/2004 Yoneda
2004/0233271 A1 11/2004 Nojima et al.
2006/0152652 A1 7/2006 Uematsu
2006/0152653 A1 7/2006 Uematsu
2008/0080897 A1 4/2008 Gomi
2008/0180515 A1 * 7/2008 Nomura et al. ..... 347/258
2009/0041504 A1 * 2/2009 Yamaguchi et al. ..... 399/220

FOREIGN PATENT DOCUMENTS

JP A-09-197567 7/1997
JP A-11-1018 1/1999
JP A-2004-134356 4/2004
JP A-2004-209772 7/2004
JP A-2006-218848 8/2006
JP A-2006-218849 8/2006
JP A-2006-289843 10/2006

(Continued)

OTHER PUBLICATIONS

Oct. 29, 2013 Office Action issued in Korean Application Nol. 10-2010-0124659 (with partial translation).

(Continued)

*Primary Examiner* — Sarah Al Hashimi
(74) *Attorney, Agent, or Firm* — Oliff PLC

(57) ABSTRACT

The invention provides an exposure head including:
a light emitting unit;
an imaging unit that allows light from the light emitting unit to enter through an incidence plane and exit from an exit surface so as to form an image at a predetermined position; and
a transparent layer provided between the light emitting unit and the imaging unit, while contacting each of the light emitting unit and the imaging unit;
the transparent layer having a thickness such that an optical distance between the light emitting unit and the incidence plane of the imaging unit becomes a working distance of the imaging unit.

6 Claims, 12 Drawing Sheets

(56) References Cited

FOREIGN PATENT DOCUMENTS

| | | | |
|---|---|---|---|
| JP | A-2008-80759 | | 4/2008 |
| JP | A-2008-194897 | | 8/2008 |
| JP | 2009051200 A | * | 3/2009 |
| JP | A-2009-51200 | | 3/2009 |
| KR | 100789871 B1 | | 1/2008 |

OTHER PUBLICATIONS

Dec. 10, 2013 Office Action issued in Japanese Application No. 2010-086235 (with English Translation).

* cited by examiner

EXPOSURE HEAD AND PRODUCING METHOD THEREOF, CARTRIDGE, AND IMAGE FORMING APPARATUS

CROSS-REFERENCE TO RELATED APPLICATIONS

This application is based on and claims priority under 35 USC 119 from Japanese Patent Application No. 2010-086235 filed on Apr. 2, 2010.

BACKGROUND

1. Technical Field

The present invention relates to an exposure head and a producing method thereof, a cartridge, and an image forming apparatus.

2. Related Art

For example, in an exposure device of an electrophotographic device and the like, an exposure head having a light emitting device as a light source has been studied.

SUMMARY

According to an aspect of the present invention, there is provided a an exposure head including:

a light emitting unit;

an imaging unit that allows light from the light emitting unit to enter through an incidence plane and exit from an exit surface so as to form an image at a predetermined position; and a transparent layer provided between the light emitting unit and the imaging unit, while contacting each of the light emitting unit and the imaging unit;

the transparent layer having a thickness such that an optical distance between the light emitting unit and the incidence plane of the imaging unit becomes a working distance of the imaging unit.

BRIEF DESCRIPTION OF THE DRAWINGS

Exemplary embodiments of the present invention will be described in detail, based on the following figures, wherein.

DETAILED DESCRIPTION

An example of exemplary embodiments according to the present invention will be described below with reference to the figures.

First Exemplary Embodiment

Figure 1:
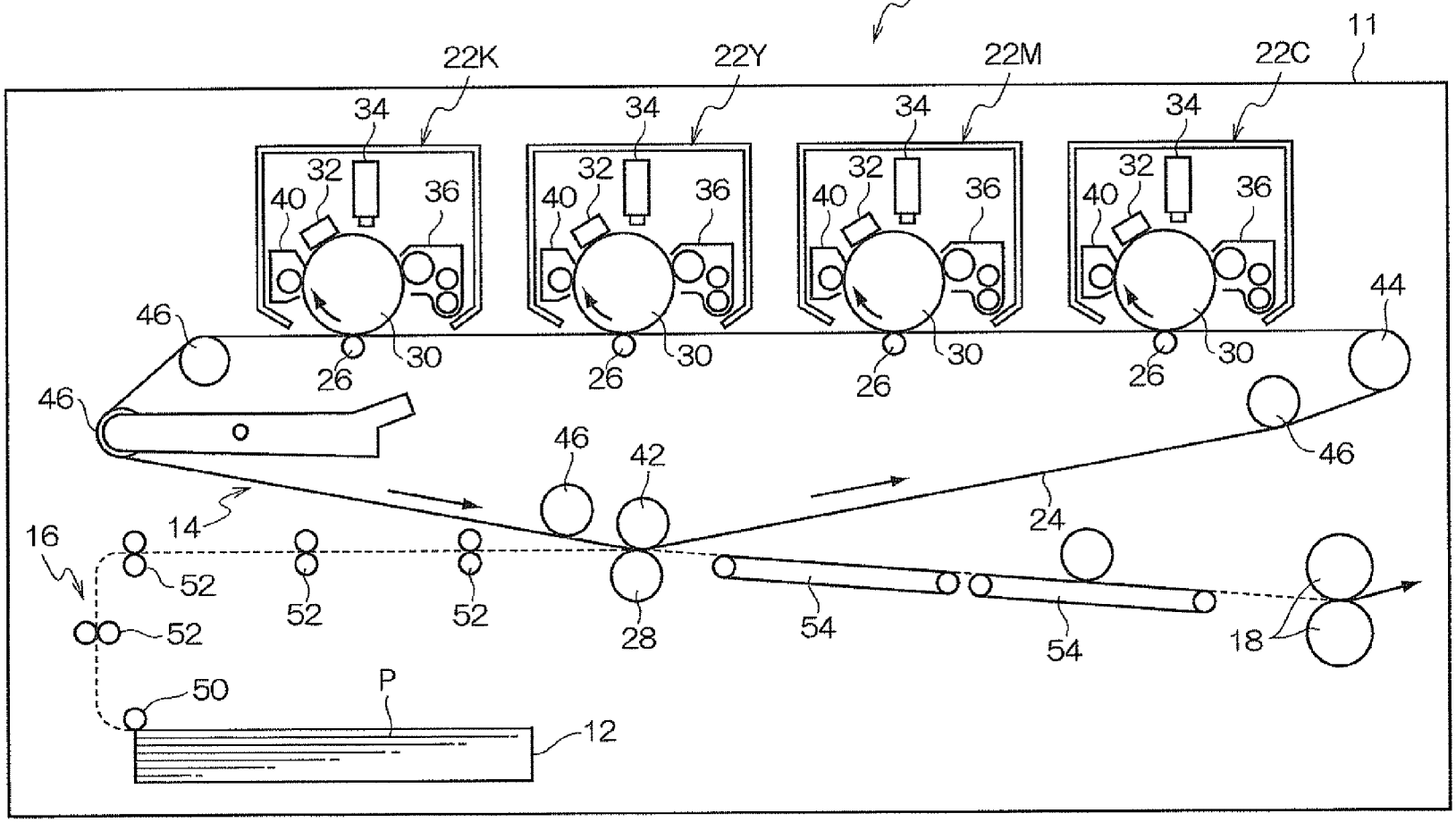
FIG. 1 is a schematic view showing a constitution of an image forming apparatus according to a first exemplary embodiment.

FIG. 1 is a schematic view showing a constitution of an image forming apparatus according to a first exemplary embodiment.

An image forming apparatus 10 according to the first exemplary embodiment, as shown in FIG. 1, is provided with an apparatus cabinet 11 that stores each component part, a recording medium storage unit 12 that stores a recording medium P such as a paper, an image forming unit 14 that forms a toner image on the recording medium P, a conveyor unit 16 that conveys the recording medium P from the recording medium storage unit 12 to the image forming unit 14, a fixing device 18 that fixes the toner image formed by the image forming unit 14 onto the recording medium P, and a recording medium ejecting unit (the illustration is omitted) that ejects the recording medium P on which the toner image has been fixed by the fixing device 18.

The recording medium storage unit 12, the image forming unit 14, the conveyor unit 16 and the fixing device 18 are stored in the apparatus cabinet 11.

The image forming unit 14 is provided with imaging units 22C, 22M, 22Y and 22K each of which forms a toner image of cyan (C), magenta (M), yellow (Y) and black (K); an intermediate transfer belt 24 as an example of intermediate transfer member, to which each of the toner images formed in the imaging units 22C, 22M, 22Y and 22K is transferred; a primary transfer roll 26 as an example of primary transfer members, that transfers each of the toner images formed in the imaging units 22C, 22M, 22Y and 22K onto the intermediate transfer belt 24; and a secondary transfer roll 28 as an example of secondary transfer members, that transfers the toner image transferred to the intermediate transfer belt 24 onto the recording medium P.

Each of the imaging units 22C, 22M, 22Y and 22K has a photoreceptor 30 which rotates in one direction (a clockwise direction in FIG. 1) as an example of image holding member that retains a latent image.

In the periphery of each photoreceptor 30, a charging device 32 that charges a surface of the photoreceptor 30, an exposure head 34 as an exposure device, that exposes the charged surface of the photoreceptor 30 to form an electrostatic latent image on the surface of the photoreceptor 30, a developing device 36 that develops the electrostatic latent image formed on the surface of the photoreceptor 30 to form a toner image, and a removing device 40 that removes the toner remaining on the surface of the photoreceptor 30 after the toner image being transferred to the intermediate transfer belt 24, are provided sequentially from the upstream side in the rotation direction of the photoreceptor 30.

The photoreceptor 30, the charging device 32, the exposure head 34, the developing device 36 and the removing device 40 are stored and unitized in the imaging units 22C, 22M, 22Y and 22K, respectively. The imaging units 22C, 22M, 22Y and 22K are made into process cartridges removably provided in the apparatus cabinet 11, and rendered exchangeable.

All of the photoreceptor 30, the charging device 32, the exposure head 34, the developing device 36 and the removing device 40 do not need to be unitized. For example, at least the exposure head 34 is provided, and at least one of the photoreceptor 30, the charging device 32 and the developing device 36 may be stored and unitized in the imaging units 22C, 22M, 22Y and 22K, respectively.

The intermediate transfer belt 24 is supported by an opposite roll 42 opposite to the secondary transfer roll 28, a drive roll 44 and a support roll 46, and is such as to cyclically move in one direction (a counterclockwise direction in FIG. 1) while contacting the photoreceptor 30.

The primary transfer roll 26 is opposite to the photoreceptor 30 while holding the intermediate transfer belt 24 therebetween. A primary transfer position in which the toner image on the photoreceptor 30 is primarily transferred to the intermediate transfer belt 24 is formed between the primary transfer roll 26 and the photoreceptor 30. In this primary transfer position, the primary transfer roll 26 is such as to transfer the toner image on the surface of the photoreceptor 30 onto the intermediate transfer belt 24 by pressing force and electrostatic force.

The secondary transfer roll 28 is opposite to the opposite roll 42 while holding the intermediate transfer belt 24 therebetween. A secondary transfer position in which the toner image on the intermediate transfer belt 24 is secondarily transferred to the recording medium P is formed between the secondary transfer roll 28 and the opposite roll 42. In this secondary transfer position, the secondary transfer roll 28 is such as to transfer the toner image on the surface of the intermediate transfer belt 24 onto the recording medium P by pressing force and electrostatic force.

The conveyor unit 16 is provided with a delivery roll 50 that delivers the recording medium P stored in the recording medium storage unit 12, and a conveyor roll pair 52 that conveys the recording medium P delivered by the delivery roll 50 to the secondary transfer position.

The fixing device 18 is disposed on the downstream side in the conveyance direction from the secondary transfer position, and fixes the toner image transferred in the secondary transfer position to the recording medium P.

A conveyor belt 54 as an example of conveyor members, for conveying the recording medium P to the fixing device 18, is disposed on the downstream side in the conveyance direction from the secondary transfer position and on the upstream side in the conveyance direction from the fixing device 18.

Through the above constitution, in the image forming apparatus 10 according to the exemplary embodiment, the recording medium P delivered from the recording medium storage unit 12 is first fed into the secondary transfer position by the conveyor roll pair 52.

On the other hand, the toner image in each color formed in the imaging units 22C, 22M, 22Y and 22K is superposed on the intermediate transfer belt 24 and formed into a color image. The color image formed on the intermediate transfer belt 24 is transferred to the recording medium P fed into the secondary transfer position.

The recording medium P to which the toner image has been transferred is conveyed to the fixing device 18, and the transferred toner image is fixed by the fixing device 18. The recording medium P to which the toner image has been fixed is ejected to the recording medium ejecting unit (the illustration is omitted). A series of image forming operations is performed in the above manner.

The constitution of the image forming apparatus is not limited to the above-mentioned constitution; for example, an image forming apparatus of a direct transfer type with no intermediate transfer medium may be used, and various constitutions may be adopted.

Next, the exposure head 34 is described.

Figure 2:
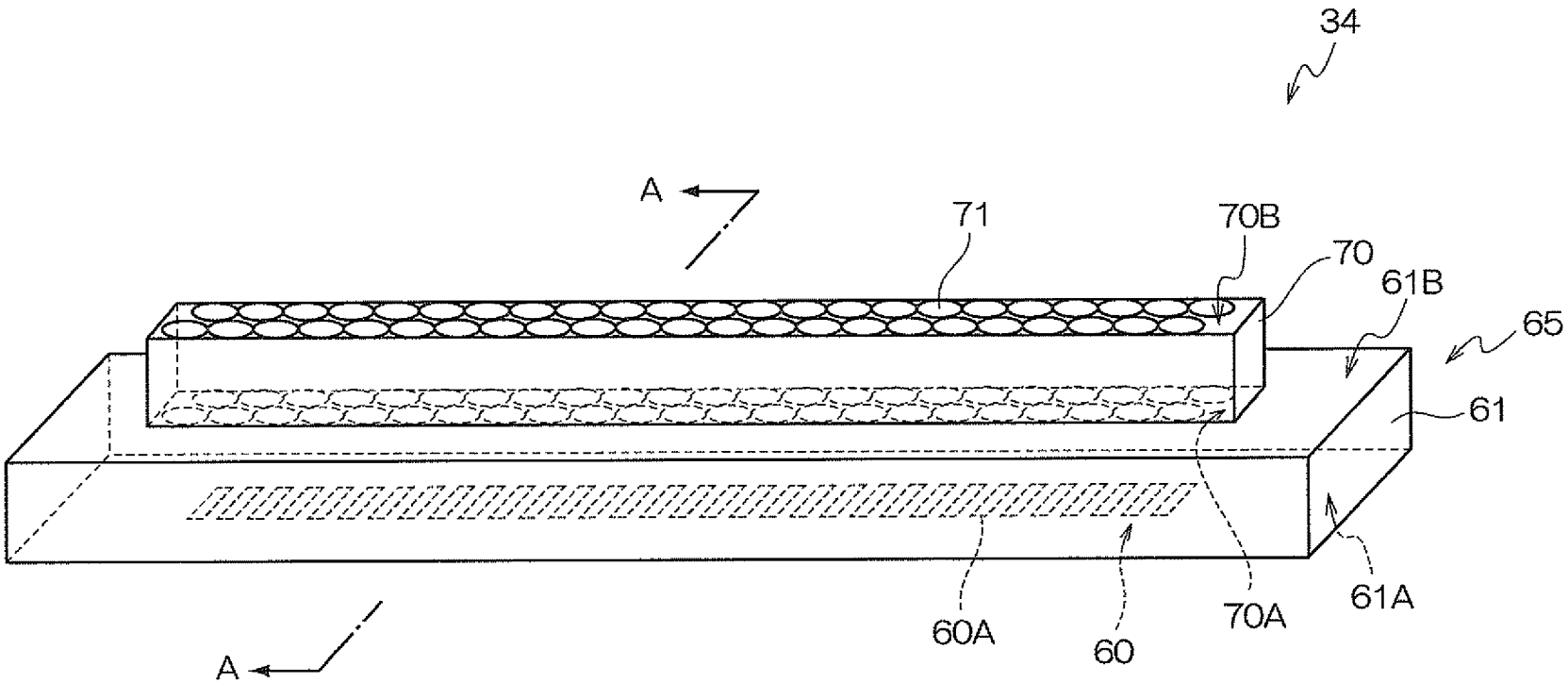
FIG. 2 is a schematic perspective view showing a constitution of an exposure head according to a first exemplary embodiment.
Figure 3:
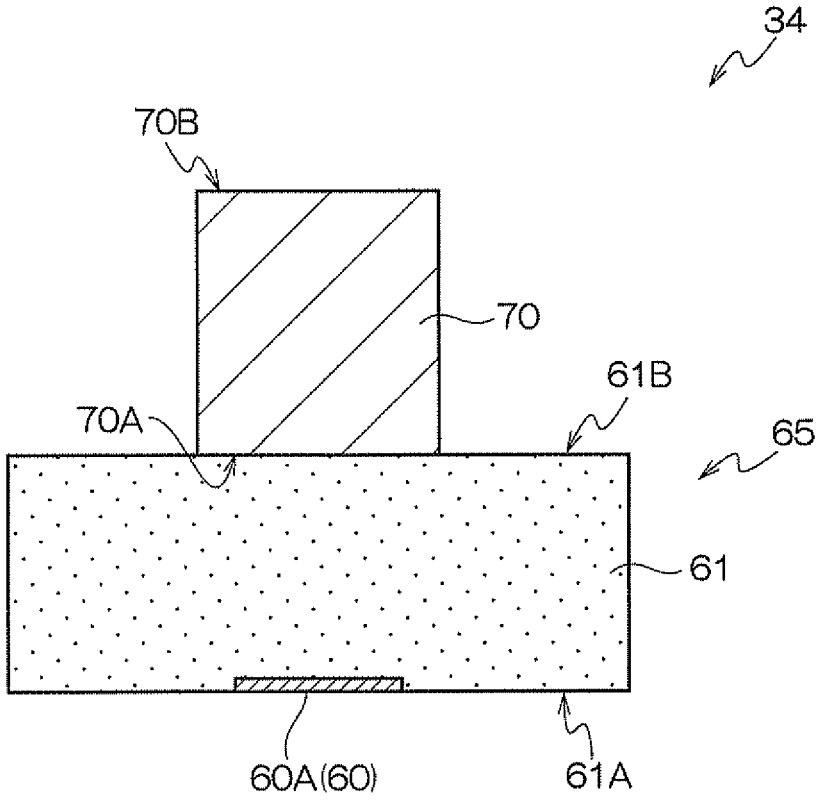
FIG. 3 is an A-A schematic cross-sectional view of FIG. 2.

FIG. 2 is a perspective view showing an exposure head according to the first exemplary embodiment. FIG. 3 is an A-A schematic cross-sectional view of FIG. 2.

Each exposure head 34, as shown in FIGS. 2 and 3, is provided with a light emitting device array 65 and an imaging unit 70, for example. The light emitting device array 65 is provided with a light emitting unit 60 composed of a light emitting device 60A, and a mounting substrate 61 (an example of transparent substrates) mounted with the light emitting device 60A, for example.

Figure 4:
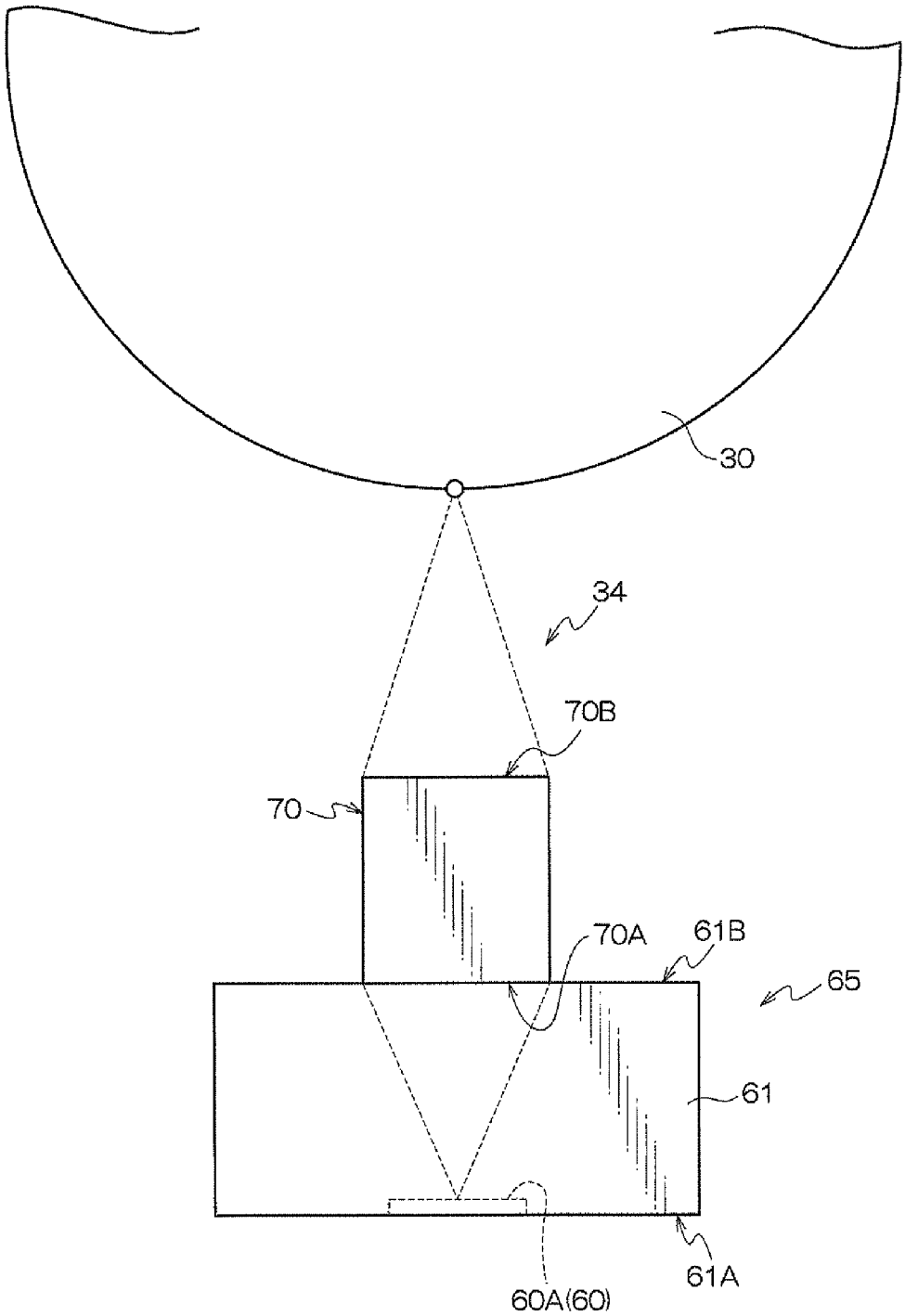
FIG. 4 is a diagrammatic view diagrammatically showing a state such that the emitted light from the exposure head is imaged on a photoreceptor.

Then, in the imaging unit 70, the emitted light from the light emitting unit 60 enters through an incidence plane 70A and exits from an exit surface 70B thereby imaging in a predetermined position, that is, the emitted light from the light emitting device 60A is imaged on the photoreceptor 30, thereby exposing the photoreceptor 30 to form a latent image (refer to FIG. 4).

The light emitting device array 65 is such as to take out light irradiated from the light emitting unit 60 (the light emitting device 60A) through the mounting substrate 61 side, the so-called bottom emission system. Thus, the mounting substrate 61 is composed of a transparent substrate with a light transmittance of 50% or more (desirably 80% or more), for example.

The mounting substrate 61 composing the light emitting device array 65 is a lengthy member elongated in a fast scanning direction X, having a first surface 61A and a second surface 61B opposite to a thickness direction.

The mounting substrate 61 is provided between the light emitting unit 60 and the imaging unit 70. Then, the mounting substrate 61 is provided integrally with the light emitting unit 60 (that is, provided with the light emitting unit 60 while composing the light emitting device array). Also, the mounting substrate 61 is provided while contacting the imaging unit 70.

Specifically, the light emitting unit 60 (the light emitting device 60A) is provided on the first surface 61A of the mounting substrate 61. That is to say, the first surface 61A of the mounting substrate 61 is a forming surface that forms the light emitting device 60A and other wiring and circuit (not shown), and the mounting substrate 61 and the light emitting unit 60 (the light emitting device 60A) are integrally provided.

On the other hand, the imaging unit 70 is provided on the second surface 61B of the mounting substrate 61. The imaging unit 70 is provided while the incidence plane 70A thereof is contacting the second surface 61B of the mounting substrate 61. Not an air layer but the mounting substrate 61 intervenes between the incidence plane 70A of the imaging unit 70 and the light emitting unit 60.

The incidence plane 70A of the imaging unit 70 is provided while contacting the mounting substrate 61 (the second surface 61B thereof), which case also signifies that the incidence plane 70A is provided while adhered with an adhesive.

The thickness of the mounting substrate 61 is a thickness such that an optical distance between the light emitting unit 60 (the light emitting device 60A) and the incidence plane 70A of the imaging unit 70 becomes a working distance of the imaging unit 70. In other words, the optical distance between the light emitting unit 60 and the incidence plane 70A of the imaging unit 70 is adjusted to the working distance of the imaging unit 70 by the thickness of the mounting substrate 61. Specifically, the thickness of the mounting substrate 61 is adjusted to a thickness such that a thickness of a layer intervening between the light emitting unit 60 (the light emitting device 60A) and the incidence plane 70A of the imaging unit 70 other than the mounting substrate 61 [that is, a layer intervening between the mounting substrate and the light emitting unit 60 (strictly a luminous point), for example a functional layer except a light emitting layer (such as an electrode) and an adhesive layer for providing the imaging unit 70] is subtracted from the working distance of the imaging unit 70.

That is to say, the optical distance between the light emitting unit 60 and the incidence plane 70A of the imaging unit 70 is in a state of being retained at the working distance of the imaging unit 70 by the mounting substrate 61 without any intervention of an air layer.

Here, the thickness of each layer such as the mounting substrate 61 described above relating to the working distance of the imaging unit 70 signifies a thickness in an area in which the light emitting unit 60 and the incidence plane 70A of the imaging unit 70 are opposed.

Here, the working distance of the imaging unit 70 refers to a distance from a focus of a lens used for the imaging unit to the incidence plane of the imaging unit.

The mounting substrate 61 is composed of a transparent substrate; specifically, for example, an insulative substrate, which is a glass substrate and a resin substrate (such as a polyethylene terephthalate substrate (PET substrate) and a polyethylene naphthalate substrate (PEN substrate)).

The light emitting unit 60 is composed of a group of the single light emitting device 60A, for example. The light emitting device 60A is not shown and linearly disposed in parallel along a longitudinal direction of the mounting substrate 61 to compose the light emitting unit 60. The light emitting unit 60 composed of a group of the light emitting device 60A has a length of an image forming area or more of the photoreceptor 30.

Appropriate examples of the light emitting device 60A include an organic electroluminescent element.

The constitution of the organic electroluminescent element is not shown and may adopt a well-known constitution, for example, having an anode, a cathode and a light emitting layer between the anode and the cathode, and optionally having each functional layer such as a charge transport layer and a charge injection layer, as required.

Examples of light emitting materials composing the light emitting layer include a chelate organic metal complex, a polynuclear or condensation aromatic ring compound, a perylene derivative, a coumarin derivative, a styrylarylene derivative, a silole derivative, an oxazole derivative, an oxathiazole derivative or an oxadiazole derivative, a polyparaphenylene derivative, a polyparaphenylene vinylene derivative, a polythiophene derivative or a polyacetylene derivative.

The light emitting unit 60 may be composed of another light emitting device such as an LED (Light Emitting Diode) element as well as the organic electroluminescent element.

The imaging unit 70 is composed of a lens array such that plural rod lenses 71 are arrayed, for example. Specifically, the lens array preferably adopts a gradient index lenses array called the Selfoc lens array (SLA: Selfoc is a registered trademark of Nippon Sheet Glass Co., Ltd.), for example.

Next, a producing method for the exposure head 34 according to the exemplary embodiment will be described.

The exposure head 34 according to the exemplary embodiment is obtained, for example, by preparing the light emitting device array 65 and the imaging unit 70, then applying and mounting the imaging unit 70 on the second surface 61B of the mounting substrate 61. This mounting of the imaging unit 70 is specifically performed, for example, while adhering and retaining the periphery with an adhesive or directly adhering the contact surface with an adhesive in a state of being applied on the second surface 61B of the mounting substrate 61.

In the exposure head 34 according to the exemplary embodiment described above, the mounting substrate 61 as a transparent substrate, having a thickness such that the optical distance between the light emitting unit 60 and the incidence plane 70A of the imaging unit 70 is adjusted so as to become the working distance of the imaging unit 70, is provided between the imaging unit 70 and the light emitting unit 60 without any intervention of an air layer.

Thus, light from the light emitting unit 60 transmits through the mounting substrate 61 without any intervention of an air layer to enter the incidence plane 70A of the imaging unit 70. Then, with regard to the light from the light emitting unit 60, it is conceived that loss in the amount of light due to reflection resulting from refractive index difference between the mounting substrate 61 and the air layer as well as refractive index difference between the air layer and the imaging unit 70 is decreased and efficiency for light utilization is improved. As a result, the amount of light is increased in the exposure head 34 according to the exemplary embodiment.

In particular, in the case in which the Selfoc lens array (SLA) is applied as the imaging unit 70, it is effective to adopt the exemplary embodiment of the present invention for the reason that this SLA has characteristics of a large loss in the amount of light and a low efficiency for light utilization as compared with another lens.

In the exposure head 34 according to the exemplary embodiment, the optical distance between the light emitting unit 60 and the incidence plane 70A of the imaging unit 70 is in a state of being retained at the working distance of the imaging unit 70 by the mounting substrate 61. Thus the mounting substrate 61 is utilized as a guide member for mounting at the time of mounting the imaging unit 70 (that is, for example, the imaging unit 70 is applied and mounted on the mounting substrate 61), whereby a high mounting accuracy is not required so that labor for mounting is decreased and lower costs in the process of mounting are realized.

Further, the working distance of the imaging unit 70 hardly fluctuates also at the time of mounting the exposure head 34 itself, whereby labor for the mounting is decreased and lower costs in the process of mounting are realized.

In particular, in the case in which the Selfoc lens array (SLA) is applied as the imaging unit 70, it is effective to adopt the exemplary embodiment of the present invention for the reason that this SLA has a shallow depth of focus and a high mounting accuracy is required.

In the exemplary embodiment, an embodiment such that light irradiated from the light emitting unit 60 (the light emitting device 60A) is taken out through the mounting substrate 61 side, or a so-called bottom emission system, is adopted as the light emitting device array 65 is described; yet, an exemplary embodiment such that light irradiated from the light emitting unit 60 (the light emitting device 60A) is taken out through the sealing substrate 62 side, or a so-called top emission system, is adopted may also be provided.

Figure 5:
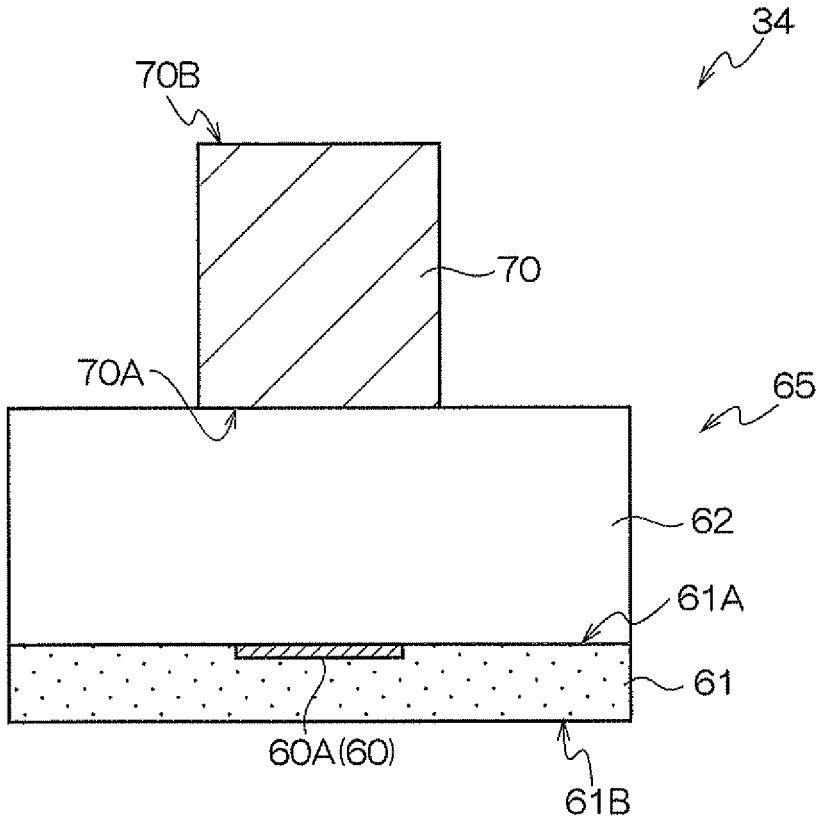
FIG. 5 is a schematic cross-sectional view showing a constitution of another exposure head according to a first exemplary embodiment.

In the case of the exemplary embodiment adopting a top emission system, as shown in FIG. 5, the sealing substrate 62 as a transparent substrate is provided between the imaging unit 70 and the light emitting unit 60 instead of the mounting substrate 61. The thickness of the sealing substrate 62 is adjusted such that the optical distance between the light emitting unit 60 and the incidence plane 70A of the imaging unit 70 becomes the working distance of the imaging unit 70.

Here, the sealing substrate 62 is a substrate for sealing and protecting the light emitting unit 60 (the light emitting device 60A) formed on the mounting substrate 61, and is specifically provided, for example, by sealing the periphery with an adhesive (an insulating material) while holding the light emitting unit 60 with the mounting substrate 61. That is to say, the sealing substrate 62 and the light emitting unit 60 (the light emitting device 60A) are integrally provided.

The sealing substrate 62 may be provided while directly contacting the light emitting unit 60, or provided through an insulating layer from the light emitting unit 60.

The sealing substrate 62 is specifically composed of the same transparent substrate as the mounting substrate 61, for example.

Second Exemplary Embodiment

Figure 6:
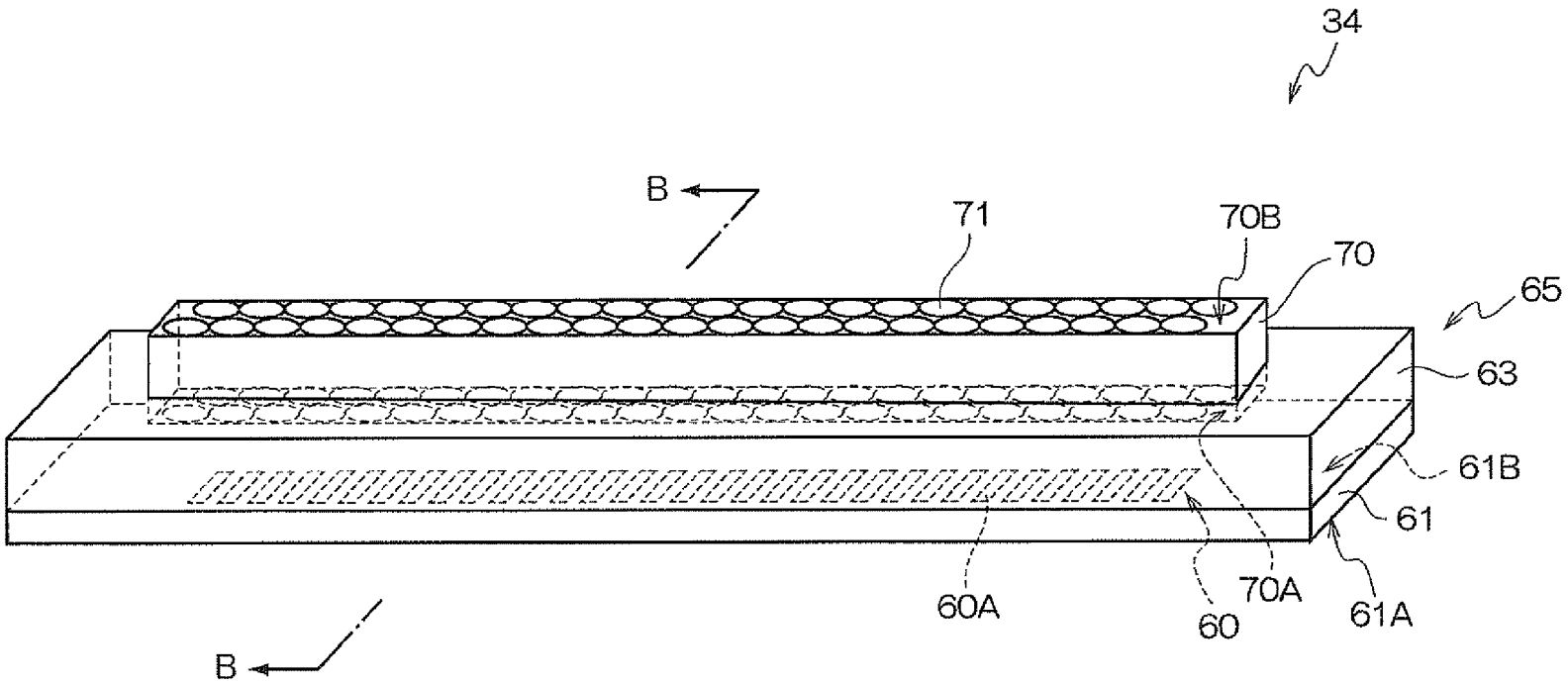
FIG. 6 is a schematic perspective view showing a constitution of the exposure head according to a second exemplary embodiment.
Figure 7:
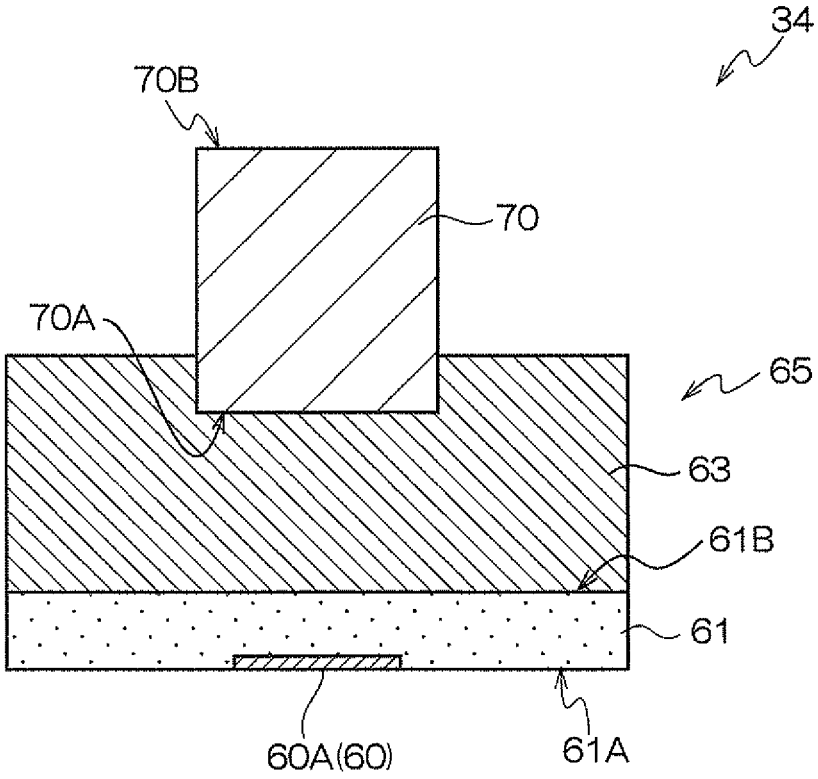
FIG. 7 is a B-B schematic cross-sectional view of FIG. 6.

FIG. 6 is a perspective view showing an exposure head according to a second exemplary embodiment. FIG. 7 is a B-B cross-sectional view of FIG. 6.

The exposure head 34 according to the second exemplary embodiment, as shown in FIGS. 6 and 7, is provided with an optical distance adjusting layer 63 (one example of transparent layers) between the mounting substrate 61 and an imaging unit 70 composing the light emitting device array 65.

The light emitting unit 60 is provided on the first surface 61A of the mounting substrate 61. On the other hand, the optical distance adjusting layer 63 is directly provided on the second surface 61B of the mounting substrate 61.

Then, the optical distance adjusting layer 63 is provided between the imaging unit 70 (the incidence plane 70A thereof) and the mounting substrate 61 (the second surface 61B thereof) while contacting each of them. Specifically, for example, the optical distance adjusting layer 63 is provided while directly laminated on the second surface of the mounting substrate 61, and meanwhile provided while the ends on the side of the incidence plane 70A of the imaging unit 70 are embedded in the optical distance adjusting layer 63. Needless to say, the imaging unit 70 does not need to be embedded in the optical distance adjusting layer 63.

That is, the area between the imaging unit 70 and the light emitting unit 60 is in a state in which the mounting substrate 61 and the optical distance adjusting layer 63 intervene without any intervention of an air layer.

The optical distance adjusting layer 63 is provided while contacting the imaging unit 70 (the incidence plane 70A thereof) and the mounting substrate 61 (the second surface 61B thereof), which case also signifies that the optical distance adjusting layer 63 is provided by using an adhesive.

The thickness of the optical distance adjusting layer 63 is a thickness within a total of the thickness of the optical distance adjusting layer 63 and the thickness of the mounting substrate 61, such that an optical distance between the light emitting unit 60 (the light emitting device 60A) and the incidence plane 70A of the imaging unit 70 becomes a working distance of the imaging unit 70. In other words, in the case where the thickness of the mounting substrate 61 is thinner than the working distance of the imaging unit 70, the optical distance between the light emitting unit 60 and the incidence plane 70A of the imaging unit 70 is adjusted to the working distance of the imaging unit 70 by adjusting the thickness of the optical distance adjusting layer 63. Specifically, the thickness of the optical distance adjusting layer 63 is adjusted to a thickness obtained by subtracting a thickness of layers intervening between the light emitting unit 60 (the light emitting device 60A) and the incidence plane 70A of the imaging unit 70 other than the optical distance adjusting layer 63 (that is, the mounting substrate 61 and layers intervening between the mounting substrate and the light emitting unit 60 (more precisely, a luminous point thereof), such as, for example functional layers other than a light emitting layer (such as an electrode) and an adhesive layer for providing the imaging unit 70) from the working distance of the imaging unit 70.

That is to say, the optical distance between the light emitting unit 60 and the incidence plane 70A of the imaging unit 70 is in a state of being retained at the working distance of the imaging unit 70 by the optical distance adjusting layer 63 and the mounting substrate 61 without any intervention of an air layer.

This thickness of each layer described above in relation to the working distance of the imaging unit 70 signifies a thickness in an area in which the light emitting unit 60 and the incidence plane 70A of the imaging unit 70 are opposed.

The optical distance adjusting layer 63 is composed of a transparent layer with a light transmittance of 50% or more (desirably 80% or more). For example, the optical distance adjusting layer 63 is preferably composed of glass, resin (such as polyethylene terephthalate (PET), polyethylene naphthalate (PEN) and other photocurable or thermosetting resin) and the like; particularly, photocurable or thermosetting resin (such as epoxy resin, polyimide resin, silicone resin and acrylic resin).

The optical distance adjusting layer 63 is preferably the same or approximate in refractive index as the mounting substrate 61; for example, refractive index difference of the mounting substrate 61 is preferably ±0.1 or less (desirably ±0.05 or less). The reason therefor is that loss in the amount of light due to reflection is caused by refractive index difference of the interface.

The optical distance adjusting layer 63 may be provided in not merely one layer but also plural layers of two layers or more. In this case, refractive index of the adjacent optical distance adjusting layers 63 is preferably the same or approximate as each other, as described above.

Next, a producing method for the exposure head 34 according to the second exemplary embodiment is described.

FIG. 8 is a process drawing showing a producing method for an exposure head according to the second exemplary embodiment.

Figure 8C:
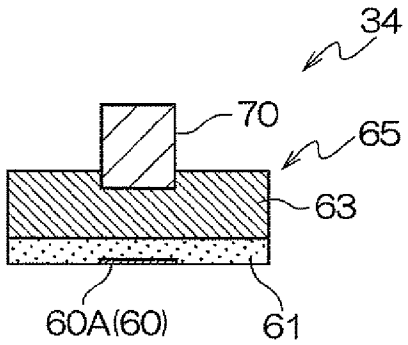
FIG. 8C is a process drawing showing a producing method for an exposure head according to a second exemplary embodiment.
Figure 8B:
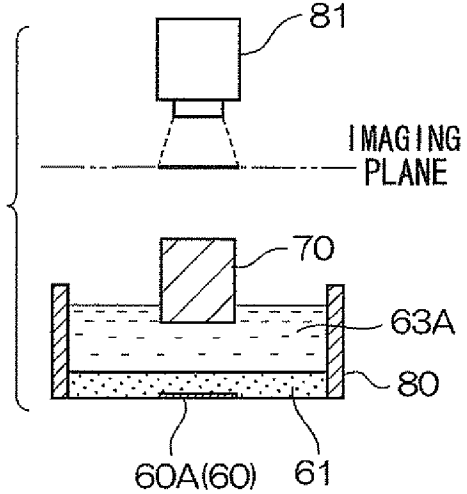
FIG. 8B is a process drawing showing a producing method for an exposure head according to a second exemplary embodiment.
Figure 8A:
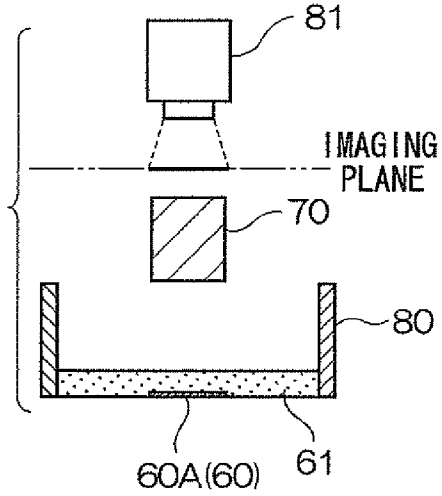
FIG. 8A is a process drawing showing a producing method for an exposure head according to a second exemplary embodiment.

First, as shown in FIG. 8A, the light emitting device array 65 is prepared. That is to say, the imaging unit 70 is prepared while preparing the mounting substrate 61 on which the light emitting unit 60 (the light emitting device 60A) has been disposed (formed).

Then, for example, image pickup is performed by an image pickup device 81 (such as a CCD (Charge Coupled Device) camera or a CMOS (Complementary Metal Oxide Semiconductor) camera), and the imaging unit 70 (the incidence plane 70A thereof) is opposed to the mounting substrate 61 (the second surface 61B thereof) of the light emitting device array 65 with an interval therebetween while observing the imaging unit 70. That is to say, the imaging unit 70 is made to opposed the mounting substrate 61 so that the mounting substrate 61 intervenes between the light emitting unit 60 (the light emitting device 60A) and the imaging unit 70.

On this occasion, the mounting substrate 61 is retained by a frame 80 for surrounding the upper second surface 61B side of the mounting substrate 61 (the area between the second surface of the mounting substrate 61 and the incidence plane of the imaging unit 70) from the side face of the mounting substrate 61. The height of this frame 80 is determined so as to be higher than the assumed working distance of the imaging unit 70.

Next, as shown in FIG. 8B, transparent curable resin 63A (liquid curable resin) is cast into the area surrounded by the mounting substrate 61 and the frame 80 in a state in which the imaging unit 70 (the incidence plane 70A thereof) opposes the mounting substrate 61 (the second surface 61B thereof). That is to say, the transparent curable resin 63A (liquid curable resin) is filled between the imaging unit 70 (the incidence plane 70A thereof) and the mounting substrate 61 (the second surface 61B thereof).

The curable resin 63A is preferably cast so as not to cause air bubbles.

Then, the distance between the light emitting unit 60 and the imaging unit 70 (the incidence plane 70A thereof) is adjusted so as to be the working distance of the imaging unit 70.

Specifically, for example, image pickup is performed by the image pickup device 81 to move the imaging unit 70 while observing the imaging (the imaging plane) through the imaging unit 70, and the distance between the light emitting unit 60 and the imaging unit 70 (the incidence plane 70A thereof) is positioned so as to be the working distance of the imaging unit 70.

Next, as shown in FIG. 8C, after the distance between the light emitting unit 60 and the imaging unit 70 (the incidence plane 70A thereof) is adjusted so as to be the working distance of the imaging unit 70, the curable resin 63A is cured in a state of positioning the imaging unit 70 to form the optical distance adjusting layer 63. This curing of the curable resin 63A may be performed by heat treatment, optical treatment and the like in accordance with the kind of the resin.

Here, damage to the light emitting device array 65 (the light emitting device 60A) due to heat treatment or optical treatment performed in curing of the curable resin 63A is preferably considered. Specifically, for example, in the case of heat treatment, the curing of the curable resin 63A is preferably performed under the conditions of 130° C. or less (desirably 100° C. or less). In the case of optical treatment, the curing of the curable resin 63A is preferably performed under the conditions of 200 mJ/cm$^2$ or less (desirably 150 mJ/cm$^2$ or less).

Refractive index variation of the optical distance adjusting layer 63 due to the curing treatment of the curable resin 63A is preferably considered. The reason therefor is that refractive index variation of the optical distance adjusting layer 63 occasionally moves the imaging position of the imaging unit 70 to deteriorate mounting accuracy. Specifically, for example, the positioning of the imaging unit 70 is preferably determined before curing treatment of the curable resin is performed by subtracting the movement of the imaging position, in accordance with the movement of the imaging position due to refractive index variation of the optical distance adjusting layer 63 during the curing treatment. The refractive index varies with the curing degree of the curable resin on an amount basis, so that it is also effective to stop the curing treatment of the curable resin 63A at the stage considered to provide the most favorable mounting accuracy.

The exposure head 34 such that the ends on the side of the incidence plane 70A of the imaging unit 70 are embedded in the optical distance adjusting layer 63 is obtained through the above-mentioned processes. The above-mentioned processes allow the exposure head 34 such that the working distance of the imaging unit 70 is easily adjusted with favorable accuracy. That is to say, the mounting position of the imaging unit 70 is restrained from shifting to allow the exposure head 34 exactly mounted therewith.

The exposure head 34 according to the exemplary embodiment may be obtained in such a manner that the imaging unit 70 is mounted while adhering and retaining the periphery with an adhesive or directly adhering the contact surface with an adhesive in a state of being applied on the optical distance adjusting layer 63 previously formed.

The constitution except the above is the same as the first exemplary embodiment, so that the description thereof is omitted.

In the exposure head 34 according to the exemplary embodiment described above, the mounting substrate 61 as a transparent substrate and the optical distance adjusting layer 63 as a transparent layer, having a thickness such that the optical distance between the light emitting unit 60 and the incidence plane 70A of the imaging unit 70 is adjusted so as to become the working distance of the imaging unit 70, are provided between the imaging unit 70 and the light emitting unit 60 without any intervention of an air layer.

Thus, light from the light emitting unit 60 transmits through the mounting substrate 61 and the optical distance adjusting layer 63 without any intervention of an air layer to enter the incidence plane 70A of the imaging unit 70.

Thus, the amount of light is increased also in the exposure head 34 according to the exemplary embodiment similarly to the first exemplary embodiment.

In particular, in the exposure head 34 according to the exemplary embodiment, an increase in the amount of light is intended even in the case where a transparent substrate (the mounting substrate 61 and the sealing substrate 62) composing the light emitting device array 65 is thinner than the working distance of the imaging unit 70.

In the exemplary embodiment, an embodiment such that light irradiated from the light emitting unit 60 (the light emitting device 60A) is taken out through the mounting substrate 61 side, or a so-called bottom emission system, is adopted as the light emitting device array 65 is described; yet, an exemplary embodiment such that light irradiated from the light emitting unit 60 (the light emitting device 60A) is taken out through the sealing substrate 62 side, or a so-called top emission system, is adopted may also be provided.

Figure 9:
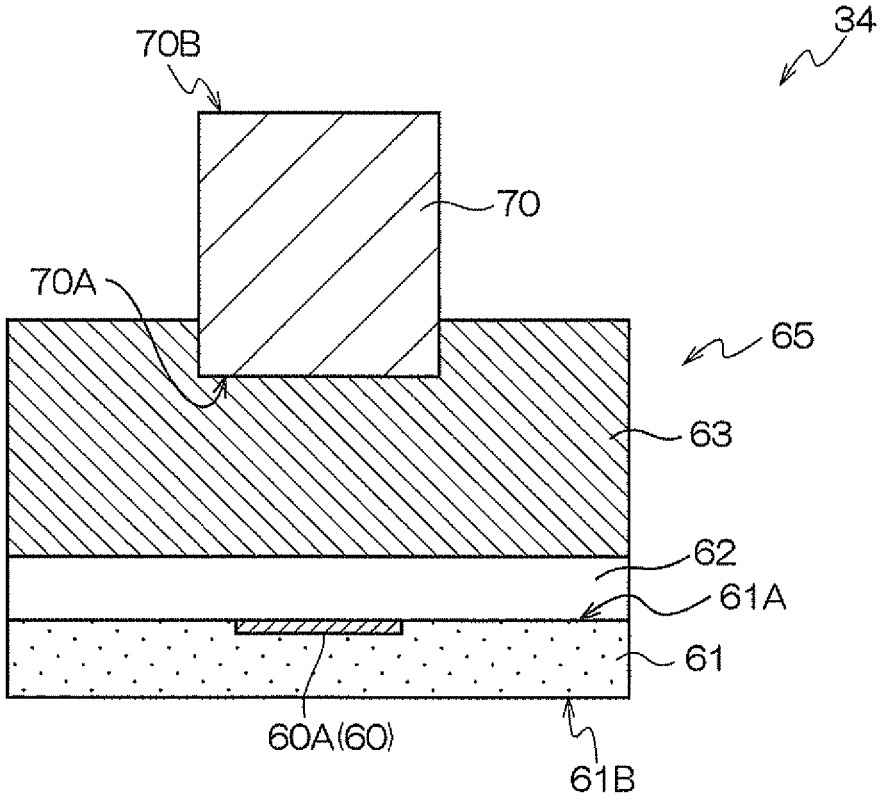
FIG. 9 is a schematic cross-sectional view showing a constitution of another exposure head according to a second exemplary embodiment.

In the case of the exemplary embodiment adopting a top emission system, as shown in FIG. 9, the sealing substrate 62 as a transparent substrate is provided between the imaging unit 70 and the light emitting unit 60 instead of the mounting substrate 61. The thickness of the sealing substrate 62 is adjusted such that a total thickness of the sealing substrate 62 and the optical distance adjusting layer 63 is adjusted such that the optical distance between the light emitting unit 60 and the incidence plane 70A of the imaging unit 70 becomes the working distance of the imaging unit 70. Then the optical distance adjusting layer 63 is provided as a transparent layer between the sealing substrate 62 and the imaging unit 70. The sealing substrate 62 is the same as in the first exemplary embodiment.

Here, the thickness of each layer described above in relation to the working distance of the imaging unit 70 signifies a thickness in an area in which the light emitting unit 60 and the incidence plane 70A of the imaging unit 70 are opposed.

Third Exemplary Embodiment

Figure 10:
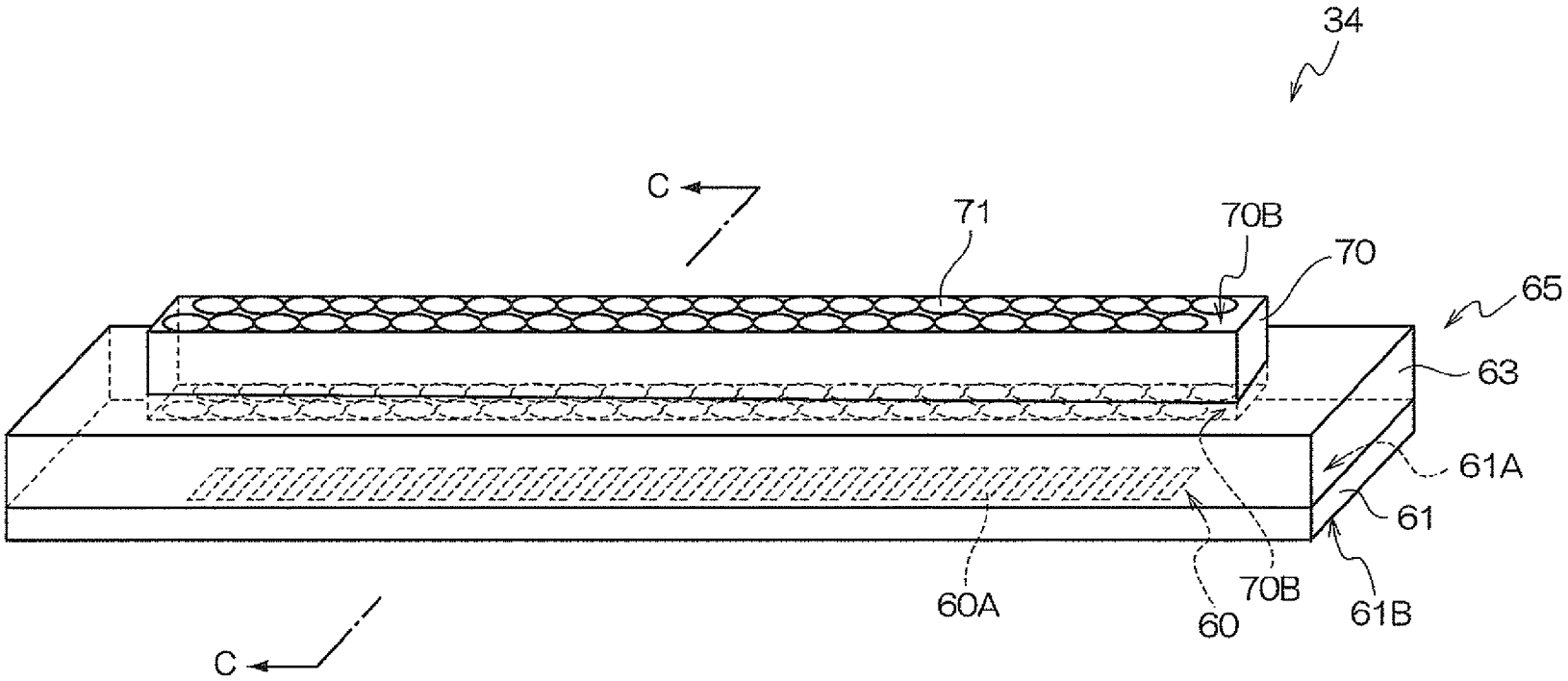
FIG. 10 is a schematic perspective view showing a constitution of an exposure head according to a third exemplary embodiment.
Figure 11:
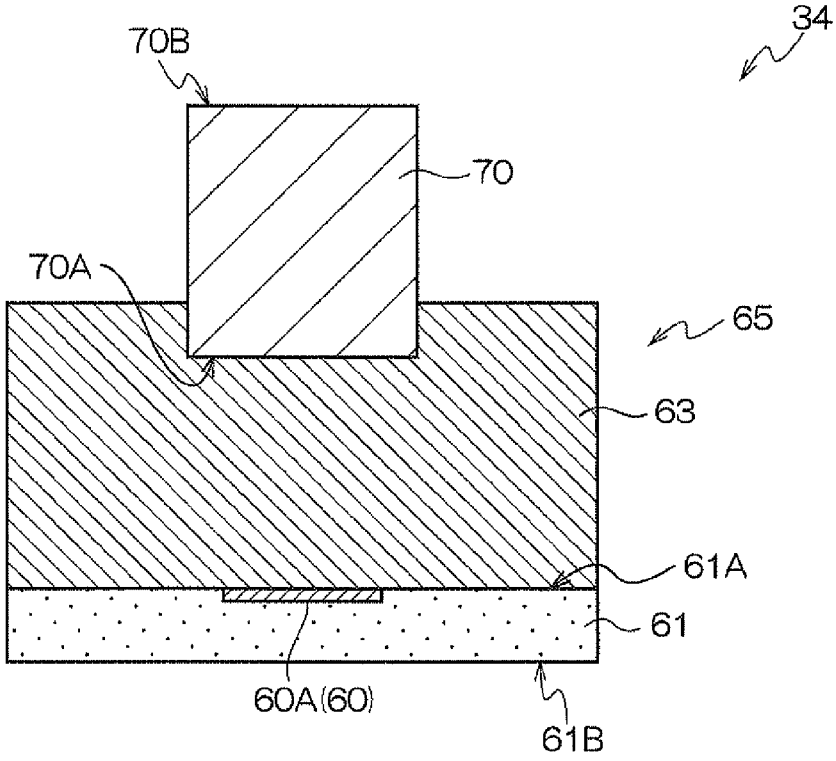
FIG. 11 is a C-C schematic cross-sectional view of FIG. 10.

FIG. 10 is a perspective view showing an exposure head according to a third exemplary embodiment. FIG. 11 is a C-C cross-sectional view of FIG. 10.

The exposure head 34 according to the third exemplary embodiment, as shown in FIGS. 10 and 11, is an embodiment of the light emitting device array 65 such that light irradiated from the light emitting unit 60 (the light emitting device 60A) is taken out through the other side of the mounting substrate 61, or a so-called top emission system, is adopted.

Then, the exposure head 34 is provided with the optical distance adjusting layer 63 (one example of transparent layers) between the light emitting unit 60 (the light emitting device 60A) composing the light emitting device array 65 and the imaging unit 70. That is to say, the optical distance adjusting layer 63 is a layer serving also as a protective layer for protecting the light emitting unit 60 (the light emitting device 60A).

The light emitting unit 60 is provided on the first surface 61A of the mounting substrate 61, and the optical distance adjusting layer 63 is provided so as to cover the light emitting unit 60.

Then, the optical distance adjusting layer 63 is provided between the imaging unit 70 (the incidence plane 70A thereof) and the light emitting unit 60 while contacting each of them.

Specifically, for example, the optical distance adjusting layer 63 is provided while directly laminated on the first surface of the mounting substrate 61 so as to cover the light emitting unit 60, and meanwhile provided while the ends on the side of the incidence plane 70A of the imaging unit 70 are embedded in the optical distance adjusting layer 63. Needless to say, the imaging unit 70 does not need to be embedded in the optical distance adjusting layer 63.

That is, the area between the imaging unit 70 and the light emitting unit 60 is in a state in which the optical distance adjusting layer 63 intervene without any intervention of an air layer.

The optical distance adjusting layer 63 is provided while contacting the imaging unit 70 (the incidence plane 70A thereof) and the light emitting unit 60, which case also signifies that the optical distance adjusting layer 63 is provided by an adhesive.

The thickness of the optical distance adjusting layer 63 is a thickness such that an optical distance between the light emitting unit 60 (the light emitting device 60A) and the incidence plane 70A of the imaging unit 70 becomes a working distance of the imaging unit 70. In other words, the optical distance between the light emitting unit 60 and the incidence plane 70A of the imaging unit 70 is adjusted to the working distance of the imaging unit 70 by the thickness of the optical distance adjusting layer 63. Specifically, the thickness of the optical distance adjusting layer 63 is adjusted to a thickness obtained by subtracting a thickness of layers intervening between the light emitting unit 60 (the light emitting device 60A) and the incidence plane 70A of the imaging unit 70 other than the optical distance adjusting layer 63 (that is, layers intervening between the optical distance adjusting layer 63 and the light emitting unit 60 (more precisely, a luminous point thereof), such as, for example, functional layers other than a light emitting layer (such as an electrode) and an adhesive layer for providing the imaging unit 70) from the working distance of the imaging unit 70.

That is to say, the optical distance between the light emitting unit 60 and the incidence plane 70A of the imaging unit 70 is in a state of being retained at the working distance of the imaging unit 70 by the optical distance adjusting layer 63 without any intervention of an air layer.

Here, the thickness of each layer described above in relation to the working distance of the imaging unit 70 signifies a thickness in an area in which the light emitting unit 60 and the incidence plane 70A of the imaging unit 70 are opposed.

Next, a producing method for the exposure head 34 according to a third exemplary embodiment is described.

Figure 12A:
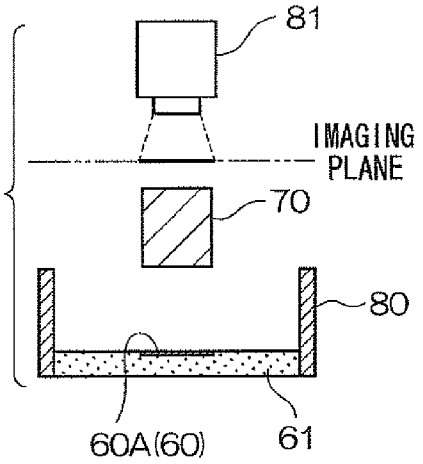
FIG. 12A is a process drawing showing a producing method for an exposure head according to a third exemplary embodiment.

FIG. 12 is a process drawing showing a producing method for the exposure head according to the third exemplary embodiment;

First, as shown in FIG. 12A, the light emitting device array 65 (that is, the light emitting unit 60 (the light emitting device 60A)) is prepared, while preparing the imaging unit 70.

Then, for example, image pickup is performed by the image pickup device 81 (such as a CCD (Charge Coupled Device) camera or a CMOS (Complementary Metal Oxide Semiconductor) camera), and the imaging unit 70 (the incidence plane 70A thereof) is opposed to the light emitting unit 60 of the light emitting device array 65 with an interval therebetween while observing the imaging unit 70. Specifically, the imaging unit 70 is made to opposed the mounting substrate 61 (the first surface 61A thereof) so that the light emitting unit 60 intervenes.

On this occasion, the mounting substrate 61 is retained by the frame 80 for surrounding the upper first surface 61A side of the mounting substrate 61 (the area between the first surface 61A of the mounting substrate 61, namely, the light emitting unit 60 and the incidence plane 70A of the imaging unit 70) from the side face of the mounting substrate 61.

Figure 12B:
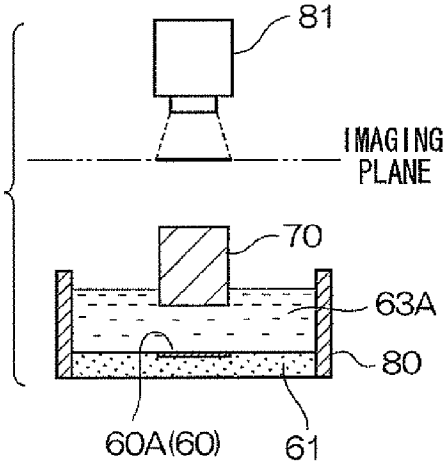
FIG. 12B is a process drawing showing a producing method for an exposure head according to a third exemplary embodiment.

Next, as shown in FIG. 12B, transparent curable resin 63A (liquid curable resin) is cast into the area surrounded by the mounting substrate 61 (the first surface 61A thereof) and the frame 80 in a state in which the imaging unit 70 (the incidence plane 70A thereof) opposes the light emitting unit 60 (the first surface 61A of the mounting substrate 61). That is to say, the transparent curable resin 63A (liquid curable resin) is filled between the imaging unit 70 (the incidence plane 70A thereof) and the light emitting unit 60.

Then, the distance between the light emitting unit 60 and the imaging unit 70 (the incidence plane 70A thereof) is adjusted so as to be the working distance of the imaging unit 70.

Specifically, for example, image pickup is performed by the image pickup device 81 to move the imaging unit 70 while observing the imaging (the imaging plane) through the imaging unit 70, and the distance between the light emitting unit 60 and the imaging unit 70 (the incidence plane 70A thereof) is positioned so as to be the working distance of the imaging unit 70.

Figure 12C:
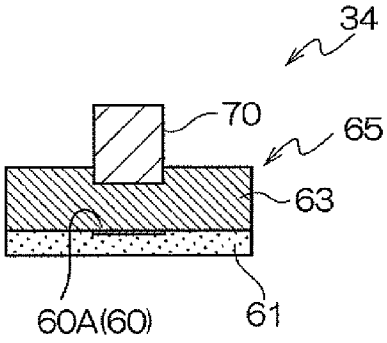
FIG. 12C is a process drawing showing a producing method for an exposure head according to a third exemplary embodiment.

Next, as shown in FIG. 12C, after the distance between the light emitting unit 60 and the imaging unit 70 (the incidence plane 70A thereof) is adjusted so as to be the working distance of the imaging unit 70, that is, the curable resin 63A is cured, in a state of positioning the imaging unit 70, to form the optical distance adjusting layer 63.

The exposure head 34 such that the ends on the side of the incidence plane 70A of the imaging unit 70 are embedded in the optical distance adjusting layer 63 is obtained through the above-mentioned processes. The above-mentioned processes allow the exposure head 34 such that the working distance of the imaging unit 70 is easily adjusted with favorable accuracy.

The constitution except the above is the same as the first and second exemplary embodiments, so that the description thereof is omitted.

In the exposure head 34 according to the exemplary embodiment described above, the optical distance adjusting layer 63 as a transparent layer, having a thickness such that the optical distance between the light emitting unit 60 and the incidence plane 70A of the imaging unit 70 is adjusted so as to become the working distance of the imaging unit 70, is provided between the imaging unit 70 and the light emitting unit 60 without any intervention of an air layer.

Thus, light from the light emitting unit 60 transmits through the optical distance adjusting layer 63 without any intervention of an air layer to enter the incidence plane 70A of the imaging unit 70.

Thus, the amount of light is increased also in the exposure head 34 according to the exemplary embodiment similarly to the first exemplary embodiment.

In particular, in the exposure head 34 according to the exemplary embodiment, an increase in the amount of light is intended even in the case where a transparent substrate (the mounting substrate 61 and the sealing substrate 62) composing the light emitting device array 65 does not intervene.

EXAMPLES

The present invention is described below by examples. The invention is not limited to only these examples.

Example 1

A glass substrate with an ITO electrode, having a size of 50 mm in length×10 mm in width, is prepared as a mounting substrate. With regard to this glass substrate, the thickness (the thickness except the ITO electrode) is previously adjusted so that an optical distance between an organic electroluminescent element (a light emitting unit) and an incidence plane of a Selfoc lens array (an imaging unit: hereinafter referred to as SLA) becomes a working distance of the imaging unit when the SLA is provided directly.

The organic electroluminescent element with a light emitting area of 400 $\mu m^2$ is formed on this glass substrate with the ITO electrode along a longitudinal direction thereof while arranged in a straight line by 1024 pieces so as to form the light emitting unit. Here, each organic electroluminescent element is formed so as to be of a bottom emission type.

Thus, a light emitting device array is produced (bottom emission type OLED [Organic light-emitting diode] print head module).

The SLA is mounted on the glass substrate (the mounting substrate) of the produced light emitting device array so as to directly contact therewith.

Thus, an exposure head is produced (refer to FIGS. 2 and 3).

Example 2

A glass substrate with an ITO electrode, having a size of 50 mm in length×10 mm in width and a thickness (thickness except the ITO electrode) of 0.7 μm is prepared as a mounting substrate.

An organic electroluminescent element with a light emitting area of 400 $\mu m^2$ is formed on this glass substrate with the ITO electrode along a longitudinal direction thereof while arranged in a straight line by 1024 pieces so as to form the light emitting unit. Here, each organic electroluminescent element is formed so as to be of a bottom emission type.

Thus, a light emitting device array is produced (bottom emission type OLED print head module).

The SLA is disposed so as to be opposed to the glass substrate (the mounting substrate) of the produced light emitting device array with an interval therebetween in a state in which the glass substrate (the mounting substrate) of the produced light emitting device array is set in a frame while observing with a commercial CMOS camera. Then, ultraviolet curable resin (PDMS: polydimethylsiloxane) is cast and filled in the area formed by the glass substrate (the mounting substrate) of the light emitting device array and the frame.

Next, the SLA is moved and positioned so that an optical distance between the organic electroluminescent element (the light emitting unit) and an incidence plane of the SLA becomes a working distance of the imaging unit while observing the imaging (the imaging plane) through the SLA with the CMOS camera (refer to FIG. 8).

In the state after positioning the SLA, the ultraviolet curable resin is subjected to ultraviolet-light irradiation and cured to form an optical distance adjusting layer, which is mounted with the SLA so as to embed the ends on the side of an incidence plane of the SLA in the optical distance adjusting layer.

Thus, an exposure head is produced (refer to FIGS. 6 and 7).

Example 3

A glass substrate with an ITO electrode, having a size of 50 mm in length×1.0 mm in width and a thickness (thickness except the ITO electrode) of 0.7 μm is prepared as a mounting substrate.

An organic electroluminescent element with a light emitting area of 400 $\mu m^2$ is formed on this glass substrate with the ITO electrode along a longitudinal direction thereof while arranged in a straight line by 1024 pieces so as to form the light emitting unit. Here, each organic electroluminescent element is formed so as to be of a top emission type.

Further, a glass substrate having a size of 50 mm in length× 10 mm in width is prepared as a sealing substrate.

With regard to this glass substrate as a sealing substrate, the thickness (the thickness except the ITO electrode) is previously adjusted so that an optical distance between an organic electroluminescent element (a light emitting unit) and an incidence plane of a Selfoc lens array (an imaging unit: hereinafter referred to as SLA) becomes a working distance of the imaging unit when the SLA is provided directly.

With using the glass substrate as a sealing substrate, the organic electroluminescent element formed on the glass substrate as a mounting substrate is sealed.

Thus, a light emitting device array is produced (top emission type OLED [Organic light-emitting diode] print head module).

The SLA is mounted on the glass substrate as the sealing substrate of the produced light emitting device array so as to directly contact therewith.

Thus, an exposure head is produced (refer to FIG. 5).

Example 4

A glass substrate with an ITO electrode, having a size of 50 mm in length×10 mm in width and a thickness (thickness except the ITO electrode) of 0.7 μm is prepared as a mounting substrate.

An organic electroluminescent element with a light emitting area of 400 $\mu m^2$ is formed on this glass substrate with the ITO electrode along a longitudinal direction thereof while arranged in a straight line by 1024 pieces so as to form the light emitting unit. Here, each organic electroluminescent element is formed so as to be of a top emission type.

Thus, a light emitting device array is produced (top emission type OLED print head module).

The SLA is disposed so as to be opposed to the organic electroluminescent element (the light emitting unit) of the produced light emitting device array with an interval therebetween in a state in which the glass substrate (the mounting substrate) of the produced light emitting device array is set in a frame while observing with a commercial CMOS camera. Then, ultraviolet curable resin (PDMS: polydimethylsiloxane) is cast and filled in the area formed by the organic electroluminescent element (the light emitting unit) of the light emitting device array and the frame (between the glass substrate (the mounting substrate), in which the organic electroluminescent element (the light emitting unit) intervenes, and the SLA).

Next, the SLA is moved and positioned so that an optical distance between the organic electroluminescent element (the light emitting unit) and an incidence plane of the SLA becomes a working distance of the imaging unit while observing the imaging (the imaging plane) through the SLA with the CMOS camera (refer to FIG. 12).

In the state after positioning the SLA, the ultraviolet curable resin is subjected to ultraviolet-light irradiation and cured to form an optical distance adjusting layer, which is mounted with the SLA so as to embed the ends on the side of an incidence plane of the SLA in the optical distance adjusting layer.

Thus, an exposure head is produced (refer to FIGS. 10 and 11).

Comparative Example 1

A glass substrate with an ITO electrode, having a size of 50 mm in length×10 mm in width and a thickness (thickness except the ITO electrode) of 0.7 μm is prepared as a mounting substrate.

An organic electroluminescent element with a light emitting area of 400 $\mu m^2$ is formed on this glass substrate with the ITO electrode along a longitudinal direction thereof while arranged in a straight line by 1024 pieces so as to form a light emitting unit. Here, each organic electroluminescent element is formed so as to be of a bottom emission type.

Thus, a light emitting device array is produced (bottom emission type OLED print head module).

The SLA is mounted on the glass substrate (the mounting substrate) side of the produced light emitting device array separately from the glass substrate (the mounting substrate) by using an SLA retaining member so that an optical distance between the organic electroluminescent element (the light emitting unit) and an incidence plane of the SLA becomes a working distance of an imaging unit.

Thus, an exposure head is produced.

Comparative Example 2

A glass substrate with an ITO electrode, having a size of 50 mm in length×10 mm in width and a thickness (thickness except the ITO electrode) of 0.7 μm is prepared as a mounting substrate.

An organic electroluminescent element with a light emitting area of 400 $\mu m^2$ is formed on this glass substrate with the ITO electrode along a longitudinal direction thereof while arranged in a straight line by 1024 pieces so as to form a light emitting unit. Here, each organic electroluminescent element is formed so as to be of a top emission type.

Thus, a light emitting device array is produced (top emission type OLED print head module).

The SLA is mounted on the organic electroluminescent element (the light emitting unit) side of the produced light emitting device array separately from the organic electroluminescent element (the light emitting unit) by using an SLA retaining member so that an optical distance between the organic electroluminescent element (the light emitting unit) and an incidence plane of the SLA becomes a working distance of an imaging unit.

Thus, an exposure head is produced.

Evaluations

The following evaluations are performed for the exposure head produced in each example. The evaluations are shown in Table 1.

—Amount of Light—

The amount of light is evaluated in the following manner. The amount of light on the imaging plane is measured by using an optical power multimeter TQ8215 (trade name, manufactured by Advantest Corporation). The average amount of light in the total 1024 bits is regarded as measured results. The results are shown in the following Table 1.

TABLE 1

| | Amount of light (nW) |
|---|---|
| Example 1 | 88.1 |
| Example 2 | 85.6 |
| Example 3 | 86.5 |
| Example 4 | 84.0 |
| Comparative Example 1 | 80.2 |
| Comparative Example 2 | 78.8 |

As is clear from the above-mentioned results that favorable results in the amount of light are obtained in the examples as compared with the comparative examples.

What is claimed is:

1. An exposure head comprising:

a light emitting unit;

an imaging unit that allows light from the light emitting unit to enter through an incidence surface and exit from an exit surface so as to form an image at a predetermined position; and a transparent sealing layer provided between the light emitting unit and the imaging unit, while contacting each of an upper surface of the light emitting unit and the imaging unit, wherein a mounting substrate having an upper surface bound to a lower surface of the transparent sealing layer around a periphery of the light emitting unit, the transparent sealing layer has a thickness such that an optical distance between the light emitting unit and the incidence surface of the imaging unit becomes a working distance of the imaging unit, and the light that passes through the imaging unit does not have a focal point within the imaging unit.

2. The exposure head according to claim 1, wherein the transparent sealing layer comprises a transparent mounting substrate provided integrally with the light emitting unit, and a second transparent layer provided between the transparent mounting substrate and the imaging unit, and a refractive index difference between the transparent mounting substrate and the second transparent layer is 0.1 or less.

3. The exposure head according to claim 1, wherein the imaging unit comprises a Selfoc lens array.

4. A cartridge comprising the exposure head according to claim 1, the cartridge being mounted removably to an image forming apparatus.

5. An image forming apparatus comprising:

a latent image holding member that holds a latent image;

the exposure head according to claim 1, that forms a latent image by irradiating light on the latent image holding member; and a developing device that develops the latent image formed by the exposure head.

6. The exposure head according to claim 1, wherein the light emitting unit is embedded within the mounting substrate.

* * * * *